United States Patent [19]

Holzgrefe

[11] Patent Number: 4,982,901

[45] Date of Patent: Jan. 8, 1991

[54] INJECTION VALVE

[75] Inventor: Volker Holzgrefe, Ditzingen, Fed. Rep. of Germany

[73] Assignee: Robert Bosch GmbH, Stuttgart, Fed. Rep. of Germany

[21] Appl. No.: 38,115

[22] Filed: Apr. 14, 1987

[30] Foreign Application Priority Data

Jul. 19, 1986 [DE] Fed. Rep. of Germany ..... 3624477

[51] Int. Cl.[5] ..... F02M 61/18; F02M 61/04; F02M 51/08

[52] U.S. Cl. ..... 239/533.12; 239/585

[58] Field of Search ..... 239/533.3–533.12, 239/585, 464, 468, 486

[56] References Cited

U.S. PATENT DOCUMENTS

| | | | |
|---|---|---|---|
| 3,035,780 | 5/1962 | Peras | 239/533.4 X |
| 3,892,362 | 7/1975 | Gayfer | 239/533.9 |
| 4,280,661 | 7/1981 | Tanasawa et al. | 239/585 X |
| 4,634,055 | 1/1987 | Hans et al. | 239/533.12 X |
| 4,651,931 | 3/1987 | Hans et al. | 239/533.9 |

FOREIGN PATENT DOCUMENTS

| | | | |
|---|---|---|---|
| 703194 | 3/1941 | Fed. Rep. of Germany | 239/533.12 |
| 51948 | 4/1980 | Japan | 239/533.3 |

*Primary Examiner*—Andres Kashnikow
*Attorney, Agent, or Firm*—Edwin E. Greigg

[57] ABSTRACT

The invention relates to an injection valve for internal combustion engine fuel injection systems. The valve is designed to inject fuel into the intake manifold. The valve comprises a valve housing containing a core with which an armature cooperates. A nozzle body with a valve seat is connected to the valve housing. A sealing seat of a valve needle guided in the nozzle head cooperates with the valve seat. The valve needle includes a central blind bore. Metering openings designed to meter fuel quantities extend from the downstream end of this blind bore. At their opposite ends these metering openings discharge directly upstream of the sealing seat.

4 Claims, 2 Drawing Sheets

INJECTION VALVE

FIELD OF THE INVENTION

The present invention relates to improvements in injection valves for internal combustion engine fuel injection systems.

BACKGROUND OF THE INVENTION

The prior art, German OS No. 34 18 762, discloses a combustion engine fuel injection valve in which the fuel is discharged in metered quantities upstream of the sealing seat (internal metering). For this purpose the valve needle is provided with metering openings through which the fuel flows with an accompanying drop in pressure. However, the disadvantage of the described injection valve is that metering takes place in a region of the valve needle disposed far upstream and, as a result, the metered fuel must flow a long distance through extensive clearance before it is discharged. Rapid and accurate discharge of the fuel is thereby impaired.

German OS No. 34 18 761 discloses an injection valve which meters the fuel upstream of the sealing seat. However, rapid starting of the flow cannot be achieved with this valve either because after metering has taken place the fuel flows into the undercut zone resulting from the manufacturing process and it is there decelerated. The resulting flow turbulence prevents the rapid passage of the fuel to the discharge end. Accordingly, this valve also operates with a delayed discharge.

OBJECT AND SUMMARY OF THE INVENTION

It is a principal object and advantage of the injection valve according to the invention to provide the feature, in contrast to the afore-mentioned valves, that after internal metering has taken place the fuel proceeds very rapidly to discharge without being decelerated in intermediate clearance zones.

It is another object of the invention to provide that fuel is discharged from the metering openings directly into the region of the valve seat, thus eliminating flow losses that might otherwise occur were the fuel to discharge more remotely from the valve seat.

It is still another object and a particularly advantageous feature of the invention that the metering openings are so arranged that the fuel is spun as it flows to the discharge end.

The invention will be better understood and further objects and advantages thereof will become more apparent from the ensuing detailed description of preferred embodiments taken in conjunction with the drawings.

BRIEF DESCRIPTION OF THE DRAWINGS

The drawings show two embodiments of the invention in simplified form. These will he described in more detail hereinafter.

DESCRIPTION OF THE PREFERRED EMBODIMENT

Figure 1:
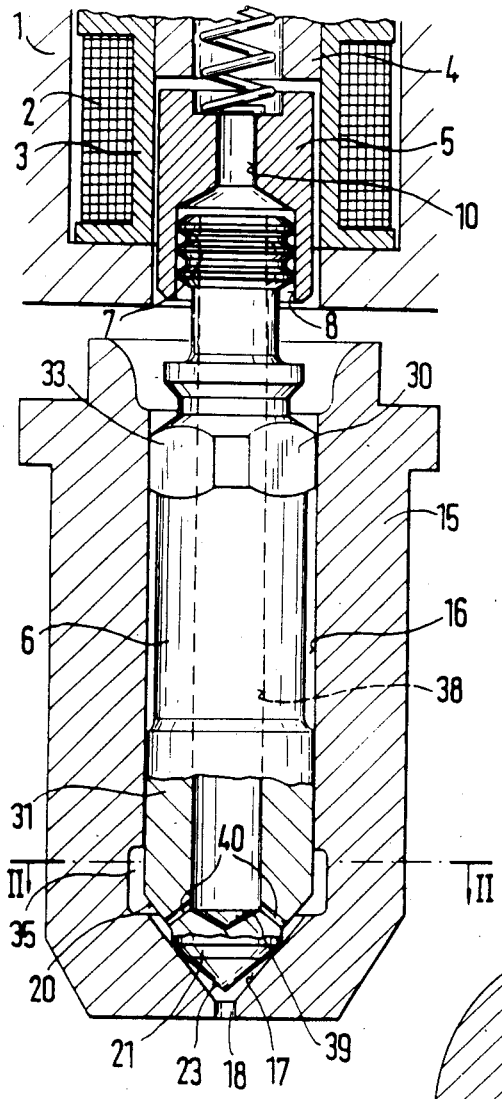
FIG. 1 shows a sectional view through an injection valve according to the invention.

FIG. 1 shows a magnetic coil 2 mounted on a coil support 3 within a valve housing 1 of a fuel injection valve which is not shown in greater detail. A ferromagnetic core 4 is disposed within the magnetic coil 2 and is partially enclosed by the same. An armature 5 which is also disposed partially within the coil support 3 is disposed opposite the front side of the core 4. The armature 5 is connected to a valve needle 6 which, in turn, fits at one end 7 into a recess 8 provided in the armature 5. The armature 5 is provided with an opening 10 penetrating axially through the same. The valve needle 6 is displaceably mounted in a nozzle body 15 which is connected to the valve housing 1 in a known manner which is not represented. The nozzle body 15 includes a coaxial guide bore 16.

In one extremity of the nozzle body remote from the magnetic coil 2 is disposed a conical valve seat 17 in which a discharge opening 18 is defined. The valve needle 6 is guided in the guide bore 16 of the nozzle body 15 and remote from the magnetic coil 2, terminates in a first conical section 20. A slightly raised narrow sealing seat 21, provided preferably in the form of a truncated cone, is disposed on the nozzle body adjacent to the first conical section 20. When the injection valve is closed the sealing seat 21 rests directly on the conical valve seat 17 of the nozzle body 15. To open the injection valve, the valve needle 6 is moved so that the sealing seat 21 is raised from the valve seat 17, thereby producing a flow passage for the fuel. The end of the valve needle 6 includes a second conical section 23 adjacent to the sealing seat 21. Thus, the sealing seat is disposed between the first and second conical sections. The second conical section 23 can he defined as a cone, as shown, or it may be provided with a pintle which, forming a coaxial extension of the valve needle 6, projects into the discharge opening 18 of the nozzle body 15.

The valve needle 6 comprises two guide parts 30 and 31 which are spaced axially apart with respect to one another. These parts 30 and 31 guide the valve needle 6 within the guide bore 16. The first guide part 30, which is disposed upstream, may be provided on its periphery with flow openings, for example, square relieved areas 33 which allow for exchange of the liquid disposed in the space between the two guide parts 30,31. Adjacent to the first conical section and the guide part 31, the guide bore 16 of the nozzle body 15 is provided with a radially disposed enlargement 35. This enlargement is necessited by the manufacturing process. The diameter of the enlargement 35, which can also be referred to as an "undercut", is larger than the diameter of the guide bore 16. The conical valve seat 17 has a wall which diverges from the discharge opening to terminate adjacent to the enlargement 35. In contrast to the first guide part 30, the second guide part 31 of the valve needle 6, which is guided in the guide bore 16 and which may be partially enclosed by the enlargement 35, must be cylindrical in shape.

The valve needle 6 includes a coaxial blind bore 38 which begins in an upper extremity of the valve needle opposite the armature 5 and terminates in an end face 39 which is disposed in proximity to the tip of the valve needle 6. Thus, the end face 39 of the blind bore 38 lies approximately at the axial region of the first conical section 20. In that region of the first conical section 20 the valve needle 6 is penetrated by at least one metering opening 40 provided to meter the fuel. The metering opening 40 leads from the blind bore 38 adjacent the end face 39 to discharge against the valve seat 17, passing out of the first conical section immediately upstream of the sealing seat 21. It is especially advantageous if the metering openings 40 are so oriented that when the valve needle 6 raises the sealing seat 21 from the valve seat 17, the fuel being discharged from the metering openings 40 is directed into the region of the conical valve seat 17 and not into the annular space formed by the radial enlargement 35.

Figure 2:
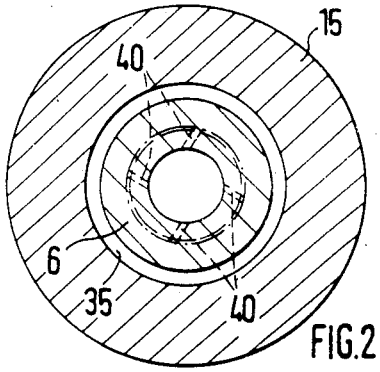
FIG. 2 shows a cross—sectional view of the injection valve taken along line II—II of FIG. 1.

As best shown in FIG. 2, the orientation of the axis of the metering openings 40 is preferably such that each opening always includes radial, axial and tangential components which are other than zero with respect to the longitudinal axis of the injection valve. As a result of the fact that the metering openings 40 also include a tangential component, a twisting motion is imparted to the fuel flowing into the conical space between the valve seat 17 and the valve needle 6. The fuel then spins along the valve seat 17 to the discharge opening 18 and leaves the discharge opening 18 in a cone-like spray pattern. Because the fuel discharged from the metering openings 40 flows directly into the region of the valve seat 17, this direct discharge eliminates any flow losses which would otherwise occur if the already metered fuel first had to flow through the annular chamber formed by the enlargement 35.

Figure 3:
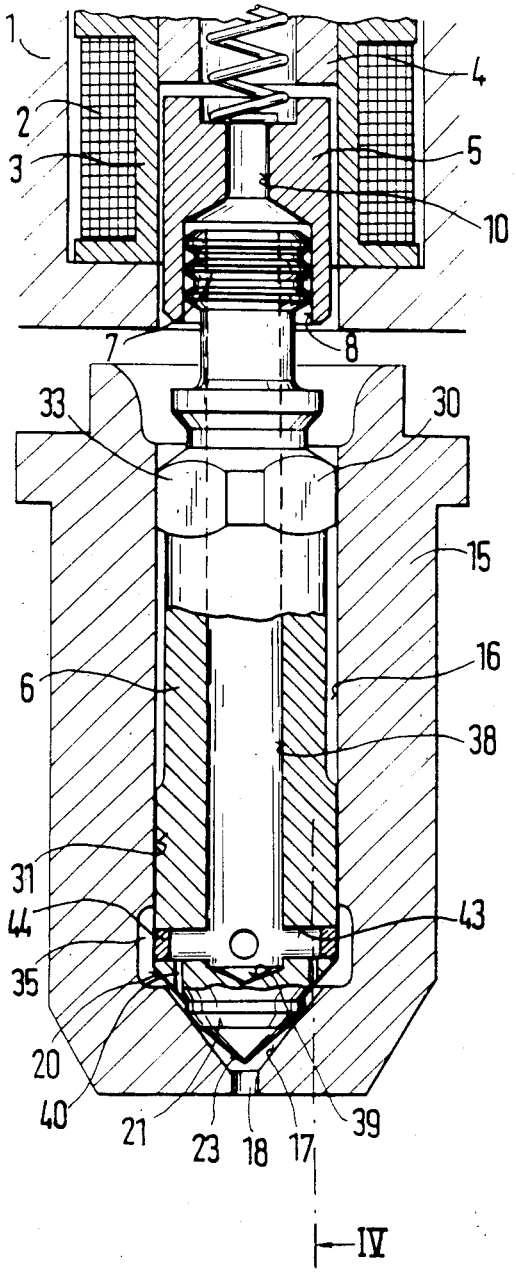
FIG. 3 shows a sectional view of another embodiment of injection valve according to the invention.
Figure 4:
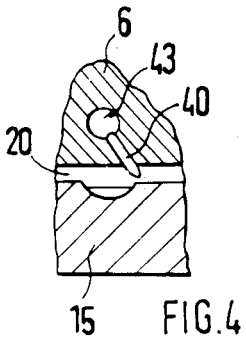
FIG. 4 shows a partial cross-sectional view of the injection valve taken through line IV—IV of FIG. 3.

FIGS. 3 and 4 show another embodiment of the invention. Identical numerals are used for equivalent parts to those in FIGS. 1 and 2. At least two radially extending transverse bores 43 are disposed in valve needle 6 and lead from the blind bore 38 adjacent the bottom 39 of the blind bore 38, lying at right angles to the longitudinal axis of the valve, terminating at the surface of the second guide part 31 of the valve needle 6.

The metering openings 40 extend from these transverse bores 43 through the valve needle, again terminating directly upstream of the sealing seat 21 on the surface of the first conical section 20. A mouth of each transverse bore 43 is closed by a stopper 44 which is secured in the transverse bore 43.

The fuel supplied via the opening 10 in the armature 5 and the blind bore 38 passes into the transverse bores 43 and flows from there into the metering openings 40 from which it is discharged directly into the region of the conical valve seat 17 when the injection valve is open. Obviously, in this embodiment as well, the fuel is subjected to a spinning action as it exits, i.e., the metering openings 40 should include a tangential orienting component.

The foregoing relates to preferred exemplary embodiments of the invention, it being understood that other variants and embodiments thereof are possible within the spirit and scope of the invention, the latter being defined by the appended claims.

What is claimed and desired to be secured by letters patent of the United States is:

1. An injection valve for internal combustion engine fuel injection systems comprising a nozzle body having a guide bore therein for receiving a valve needle, said guide bore terminating in a conical valve seat having an adjacent discharge opening, said valve needle including peripheral guide portions adapted to guide same in said guide bore, said valve needle being provided with a blind bore, at least one transverse bore projecting normal to a longitudinal axis of said injection valve, at least one metering opening extending through said valve needle from said at least one transverse bore to permit a fuel flow from said blind bore and said at least one transverse bore to said at least one metering opening to allow fuel supplied to said injection valve to communicate with said discharge opening, said valve needle further provided with first and second conical sections at an extremity thereof adapted to cooperate with said valve seat, said second conical section having an outer wall, a portion of which defines an outwardly projecting sealing seat, said sealing seat being arranged to cooperate with the valve seat to control opening and closing of the injection valve, and said at least one metering opening terminating in an outlet disposed immediately adjacent to and upstream from the sealing seat and facing said valve seat.

2. An injection valve as claimed in claim 1, further wherein said at least one metering opening discharges through said first conical section upstream of said sealing seat.

3. An injection valve as claimed in claim 1, further wherein said at least one transverse bore penetrates through the valve needle and is capped by stopper means.

4. An injection valve as claimed in claim 3, further wherein said at least one metering opening is oriented with respect to said longitudinal axis of the injection valve as to have a tangential positioning component.

* * * * *